US007144010B2

(12) United States Patent
Shanahan

(10) Patent No.: US 7,144,010 B2
(45) Date of Patent: Dec. 5, 2006

(54) CARD GAME WITH PREDETERMINED HANDS IN A FORTUNE COOKIE

(76) Inventor: John M. Shanahan, 200 S. Bay Front, Balboa Island, CA (US) 92662

( * ) Notice: Subject to any disclaimer, the term of this patent is extended or adjusted under 35 U.S.C. 154(b) by 978 days.

(21) Appl. No.: 09/888,145

(22) Filed: Jun. 22, 2001

(65) Prior Publication Data

US 2002/0195774 A1 Dec. 26, 2002

(51) Int. Cl.
*A63F 3/00* (2006.01)

(52) U.S. Cl. ..... 273/292; 273/161

(58) Field of Classification Search ..... 273/138.1, 273/139, 292, 153 R, 161; D21/813
See application file for complete search history.

(56) References Cited

U.S. PATENT DOCUMENTS 2,254,545 A * 9/1941 Roberts ..... 206/103
3,768,813 A * 10/1973 Reynolds ..... 273/149 P
3,770,278 A * 11/1973 Mueller ..... 273/153 R
3,863,362 A 2/1975 Borianne
4,775,154 A 10/1988 Clinnin et al.
D436,391 S * 1/2001 Sannito et al. ..... D21/813

* cited by examiner

*Primary Examiner*—Vishu K. Mendiratta
(74) *Attorney, Agent, or Firm*—Rader, Fishman & Grauer PLLC

(57) ABSTRACT

A game of cards utilizing predetermined hands of cards embedded in a fortune cookie is disclosed. The invention can be used by as few as one sole player or by as many as many players as the card game itself permits to play the game. Each hand can contain as few cards as one sole card, or as many cards as is required to play any card game. In one preferred embodiment provides for the ability to discard cards, and thus the invention enables users to play card games requiring cards to be discarded or exchanged with other players. The invention discloses alternative use for the traditional fortune cookie, and provides a unique and valuable opportunity for persons to interact in light-hearted games of chance at the conclusion of a meal.

11 Claims, 1 Drawing Sheet

CARD GAME WITH PREDETERMINED HANDS IN A FORTUNE COOKIE

BACKGROUND OF THE INVENTION

1. Field of the Invention

The present invention relates generally to card games, and more particularly to card games having predetermined hands of cards embedded in fortune cookies.

2. Description of the Related Art

Eating fortune cookies after a meal, and sharing the written predictions or fortunes contained therein is a well-established and rich tradition. The strength of that tradition masks the lack of alternative uses for fortune cookies found in the prior art. Fortune cookies provide a unique and valuable opportunity for persons to interact with games and light-hearted discussion at the conclusion of a meal. For those interested in something different than merely reading a fortune, the existing art does not provide a solution. Those interested in the opportunity to engage in a quick competitive game chance of chance at the conclusion of a meal are required to plan in advance, and bring their own cards to dinner, and act precluding the spontaneous thrill usually associated with a quick game of cards.

Nothing in the prior art provides a solution to this problem. While it is known in the art to place game cards with food products, nothing suggests the specific opportunities provided by fortune cookies. Other known prior art recognizes the utility of using predetermined hands of cards when a conventional card deck is not convenient because of the locale where a game is to be played. However, the prior art fails to suggest the numerous packaging opportunities made available by non-conventional card decks. Moreover, no prior art card game uses alternative packaging for a poker hand, much less the idea of embedding predetermined card hands into fortune cookies to allow for a quick game of chance with friends after a shared meal.

SUMMARY OF THE INVENTION

The present invention is a novelty item to be used in a game involving fortune cookies and the like. The game includes at least one strip of paper having one hand unit of cards. Each hand unit displays one or more cards thereon, with each card having exactly one suit and denomination. A strip of paper is embedded into a fortune cookie in the conventional manner that traditional fortunes are currently embedded into fortune cookies.

During or after a meal (or any gathering of two or more people), the fortune cookies are broken open and the hand units of the strips of paper are compared to determined a winner based on traditional card game rules. Some examples include poker or high/low (i.e., who has the highest card).

In an alternative embodiment, the strip of paper may have a perforated line located between adjacent cards to allow each individual card to be selectively separated and discarded. The ability to discard cards allows the present invention to accommodate many different types of card games. The number of cards in a hand may vary to accommodate many different types of game rules.

DESCRIPTION OF THE PREFERRED EMBODIMENT

Figure 1:
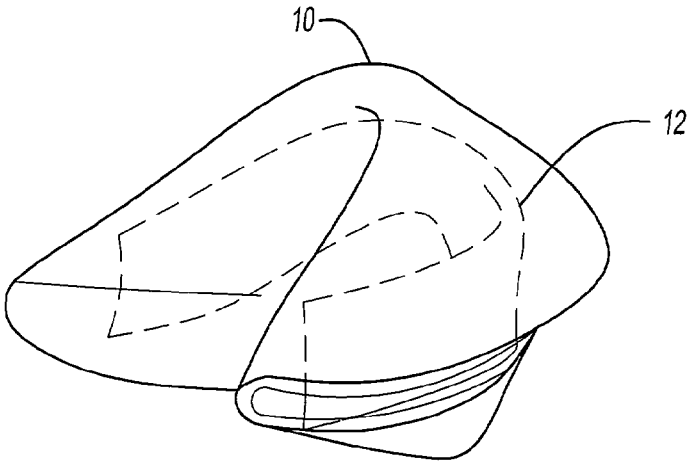
FIG. 1 is a perspective view of a fortune cookie with dotted lines indicating the embedded position of the strip of paper.

Referring now to the drawings, there is illustrated in FIG. 1 a drawing of a strip of paper 12 embedded in a fortune cookie 10. The strip of paper 12 is embedded into the fortune cookie in the conventional manner that traditional fortunes are currently embedded into fortune cookies under the existing art. The fortune cookie 10 may contain one or more strips of paper 12. The fortune cookie 10 is opened in any conventional manner that traditional fortune cookies are opened in the existing art.

Figure 2:
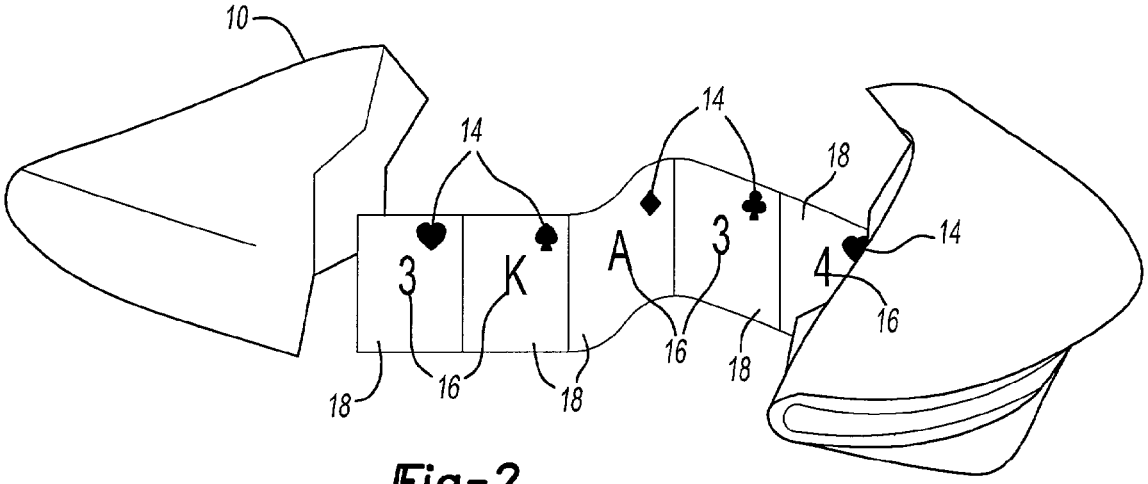
FIG. 2 is a perspective view of a fortune cookie containing a strip of paper that has been opened.

Illustrated in FIG. 2 is a drawing of a fortune cookie 10 that has been opened. The strip of paper 12 is separable from the fortune cookie 10 upon the opening of the fortune cookie 10. Removal of the strip of paper 12 from the fortune cookie 10 reveals that each individual card 18 bears the indicia of one denomination 16 and one suit 14. The indicia is printed on the strips of paper 12 by any suitable method. The strip of paper 12 could contain as few as one card, or the strip of paper 12 could contain virtually as many cards as required to play a particular card game. The size of the strip of paper 12, the size of the indicia of denomination 16, and the size of the indicia of suit 14 could each be adjusted to incorporate a greater or lesser number of cards.

Figure 3:
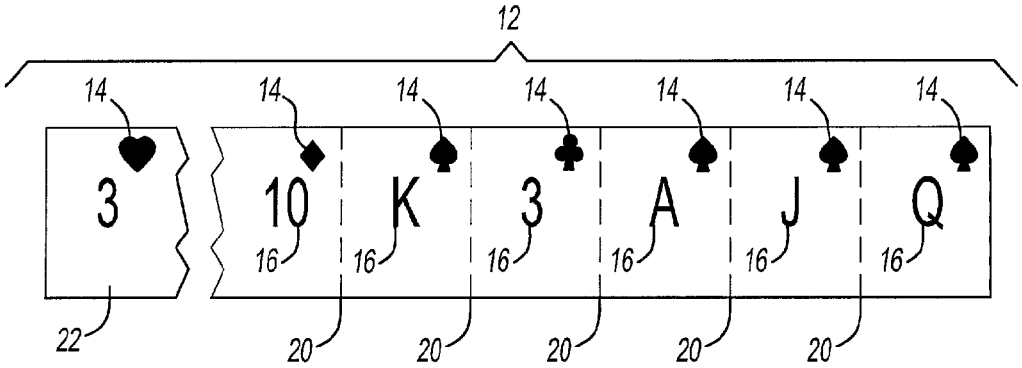
FIG. 3 is a perspective view of the strip of paper with perforated lines in between every two adjacent cards, and the left most card already separated from the strip of paper.

In one preferred embodiment, between every two adjacent cards is line 20 dividing the two adjacent cards. The line 20 is perforated to allow the selective separation and removal of individual cards 18 from the strip of paper 12. For example, it strip of paper 12 contained a seven card poker hand, line 20 would permit selective discard of two cards. Referring to FIG. 3, the left most card 22 on the strip of paper 12 has been removed from the strip of paper 12. The remaining cards 16 are subject to removal from the strip of paper 12 by the traditional means in the prior art in which perforated edges are separated.

In accordance with one aspect of the invention, a group of people (having at least two people therein) are provided with a fortune cookie 10. Each person breaks open the fortune cookie 10 to reveal at least one strip of paper 12 having a pre-printed poker hand. The respective strips of paper 12 of each person are compared against one another to determine a winner. If the meal is played at a resterant, the winner's meal is paid for by the other players. In the alternative embodiment, each individual selectively removes individual cards 22 to play a card game.

While the invention has been specifically described in connection with certain specific embodiments thereof, it is to be understood that this is by way of illustration and not of limitation, and the scope of the appended claims should be construed as broadly as the prior art will permit. A person of ordinary skill in the art will realize that certain modifications and variations will come within the teachings of this invention and that such variations and modifications are within its spirit and the scope as defined by the claims. For example, this invention may be utilized with new types of game rules as such new game rules are devised.

What is claimed is:

1. A pre-dealt card game comprising at least two separate hand units of cards, with each said hand unit comprising:

a plurality of strips of paper, wherein each of said strips of paper displays all of said cards in said hand unit;

a fortune cookie;

wherein each of said plurality of strips of paper displays at least one said card bearing the visible indicia of one predetermined suit and denomination; and wherein more than one of said strips of paper are located at least partially inside said fortune cookie.

2. The card game in claim 1, wherein no two cards in a single strip of paper bear both the same suit and the same denomination of any other card on said single strip of paper.

3. The card game in claim 2, wherein no card in any said hand unit displays both the same suit and same denomination of any other card in a concurrent hand unit.

4. A pre-dealt poker game comprising at least two separate hand units of cards, with each said hand unit comprising:

a strip of paper bearing at least five cards, said cards bearing the visible indicia of one predetermined suit and denomination;

a fortune cookie;

wherein no two cards in said unit are identical in suit and denomination; and wherein said strip of paper is located at least partially inside said fortune cookie so that the suit and denomination of card are not visible without breaking said fortune cookie; and wherein between every two adjacent cards is a perforation extending across said strip to allow selective separation of each card on said strip.

5. The card game in claim 4, wherein no two cards in any concurrent hand unit display both the same suit and the same denomination.

6. The card game in claim 4, wherein players discard a predetermined number of cards before disclosing their hand to any other players to determine a winner.

7. The card game in claim 6, wherein a person having a winning hand unit has a meal paid for by the persons having losing hand units.

8. A novelty item comprising:

at least one strip of paper displaying one hand unit of cards, with each said hand unit comprising one or more cards with each said card bearing the indicia of one suit and one denomination to define a card game hand; and a fortune cookie containing said strip so that said indicia are not visible without breaking said fortune cookie; and wherein every two adjacent said cards are separated by a perforation across said strip of paper which allows each said card to be selectively separated from said strip.

9. The novelty item in claim 8, wherein no two said cards on any said strip of paper bear the same indicia of suit and the same indicia of denomination.

10. The novelty item in claim 9, wherein no two said cards on any concurrent hand bear the same indicia of suit and the same indicia of denomination.

11. A pre-deal card game comprising at least two separate hand units of cards, with each said hand unit comprising:

a strip of paper that displays all of said cards in a said hand unit;

a fortune cookie;

wherein said strip of paper displays at least one said card bearing the visible indicia of one predetermined suit and denomination;

wherein said strip of paper is located at least partially inside said fortune cookie; and wherein said hand unit contains at least two adjacent cards displayed on said strip of paper and between every two adjacent cards is a perforation across said strip of paper to allow selective separation of each of said card on said strip of paper.

* * * * *